US005775828A

United States Patent [19]

Ikeda

[11] Patent Number: 5,775,828

[45] Date of Patent: Jul. 7, 1998

[54] WRITING IMPLEMENT

[75] Inventor: Yasuo Ikeda, Naka-Gun, Japan

[73] Assignee: Kabushiki Kaisha Pilot, Tokyo-to, Japan

[21] Appl. No.: 557,190

[22] PCT Filed: Jul. 12, 1995

[86] PCT No.: PCT/JP95/01388

§ 371 Date: Dec. 4, 1995

§ 102(e) Date: Dec. 4, 1995

[87] PCT Pub. No.: WO96/05072

PCT Pub. Date: Feb. 22, 1996

[30] Foreign Application Priority Data

Aug. 9, 1994 [JP] Japan ..... 6-187500
Aug. 9, 1994 [JP] Japan ..... 6-187559

[51] Int. Cl.[6] ..... B43K 8/00; B43K 1/04

[52] U.S. Cl. ..... 401/222; 401/231; 401/233; 401/236; 401/266

[58] Field of Search ..... 401/256, 250, 401/231, 266, 267, 249, 241, 232, 233, 235, 236, 221, 222, 227, 229

[56] References Cited

U.S. PATENT DOCUMENTS

| | | | |
|---|---|---|---|
| 143,347 | 9/1873 | Holman | 401/267 |
| 265,885 | 10/1882 | Stoakes | 401/267 |
| 1,003,942 | 9/1911 | Penn | 401/221 |
| 2,071,985 | 2/1937 | Oelbaum . | |
| 2,273,702 | 2/1942 | George | 401/267 |
| 2,432,012 | 12/1947 | Hanle | 401/221 |
| 2,581,740 | 1/1952 | Wing | 401/227 X |
| 2,634,707 | 4/1953 | McClure . | |
| 2,669,224 | 10/1954 | Miessner . | |
| 2,796,047 | 10/1957 | Lehr . | |

FOREIGN PATENT DOCUMENTS

| | | | |
|---|---|---|---|
| 1001437 | 2/1952 | France | 401/256 |
| 2530331 | 2/1977 | Germany | 401/231 |
| 31 18 390 | 11/1982 | Germany . | |
| 3297 | of 1872 | United Kingdom | 401/222 |
| 586917 | 4/1947 | United Kingdom | 401/232 |

*Primary Examiner*—Steven A. Bratlie
*Attorney, Agent, or Firm*—Wenderoth, Lind & Ponack, L.L.P.

[57] ABSTRACT

A writing implement of the present invention is capable of stably feeding ink to the tip of a writing member so that the writing member is able to draw lines in a fixed width and in a fixed ink density. The writing member is formed by superposing thin strips so as to form an ink passage of the shape of a minute gap therebetween. The ink is fed to the tip of the writing member by capillarity of the ink passage. Thus, the ink can be always stably fed to the tip of the writing member regardless of changes of the environment.

10 Claims, 11 Drawing Sheets

WRITING IMPLEMENT

TECHNICAL FIELD

The present invention relates to a writing implement and, more particularly, to a writing implement that feeds the tip of a nib with ink contained in an ink tank to write characters and the like on a sheet of writing paper by bringing the tip of the nib into contact with the writing paper.

BACKGROUND ART

A fountain pen is a generally known writing implement provided with a nib formed by processing a metal plate. As shown in FIG. 19, a nib 1 for a fountain pen is pressed in a neck tube 3 so as to be in contact with the surface of the end a feed tube 2. A slit 1*a* is formed in the nib 1 from the middle part to the tip 1*b*. The feed tube 2 is provided with an ink feed groove 2*a* in its surface in contact with the nib 1. The ink feed groove 2*a* extends to the base end of the feed tube 2 and communicates with the interior of an ink tank 4 detachably mounted on the end of the neck tube 3 opposite Nit 1.

The ink contained in the ink tank 4 flows through the ink feed groove 2*a* to the slit 1*a* of the nib 1 and the slit 1*a* guides the ink to the tip 1*b*. Thus, the tip 1*b* of the nib 1 is put in contact with a sheet of writing paper to write characters and the like on the sheet of writing paper.

As shown in FIG. 21, the feed tube 2 is provided with an air vent groove 2*b* communicating with the interior of the ink tank 4, and collector grooves 2*c*. As shown in FIGS. 22 and 23, the air vent groove 2*b* communicates with an air vent groove 2*e* by means of a connecting groove 2*d*. As the ink contained in the ink tank 4 is consumed through the nib 1, a quantity of air corresponding to a consumption of the ink flows through the air vent groove 2*e*, the connecting groove 2*d* and the air vent groove 2*b* into the ink tank 4 in bubbles to enable the ink to flow smoothly from the ink tank 4 to the nib 1.

The collector grooves 2*c* communicate with the interior of the ink tank 4 by means of the ink groove 2*a*. The ink forced to flow out of the ink tank 4 by the expansion of air in the ink tank 4 is stored in the collector grooves 2*c*.

The nib 1 must be in close contact with the feed tube 2 with the slit 1*a* in alignment with the ink feed groove 2*a* because the ink is transferred from the ink feed groove 2*a* of the feed tube 2 to the slit 1*a* of the nib 1 by capillarity. However, it is difficult, in view of manufacturing tolerance, to put the nib 1 in close contact with the feed tube 2 with the slit 1*a* in alignment with the ink feed groove 2*a* and, in most cases, the slit 1*a* is slightly dislocated from the correct position relative to the ink feed groove 2*q* as shown in FIG. 20.

If the slit 1*a* is dislocated relative to the ink feed groove 2*a*, a gap 5 is formed between the nib 1 and the feed tube 2 and the gap 5 is filled up with the ink by capillarity and the ink is fed from the ink feed groove 2*a* of the feed tube 2 through the gap 5 to the slit 1*a* of the nib 1. If writing is interrupted and the fountain pen is left unused for a while, the ink filling up the gap 5 dries and the dry ingredients of the ink accumulate in the gap 5.

If the dry ingredients of the ink accumulate in the gap 5, the dry ingredients of the ink block the flow of the ink from the ink feed groove 2*a* to the slit 1*a* of the nib 1 and, consequently, it is impossible to write with the fountain pen after the same has been left unused for a while.

Nibs proposed to solve such a problem are disclosed in Japanese Utility Model Laid-open Nos. 2-36485 and 58-45093. The nib disclosed in Japanese Utility Model Laid-open No. 2-36585 is formed by folding a plate in two, and has an ink passage formed between the overlapping portions of the folded plate to feed the ink to the tip thereof. The nib disclosed in Japanese Utility model Laid-open No. 58-45093 is formed by superposing a metal plate and a synthetic resin plate one on top of the other, and has an ink passage formed between the metal plate and the synthetic resin plate to feed the ink to the tip thereof.

Since the ink passage of the nib disclosed in Japanese Utility Model Laid-open Nos. 2-36485 or 58-45093, not like the ink passage of the conventional fountain pen, is not open, it is difficult for the ink filling up the ink passage to dry. However, once the ink passage is clogged with the dry ingredients of the ink, the dry ingredients of the ink clogging the ink passage cannot be removed by pressing the tip of the nib against a sheet of paper, which is a usual practice to remove the dry ingredients of the ink clogging the ink passage of a fountain pen provided with the conventional nib of a single plate, because the two thin plates forming the nib cannot be moved relative to each other.

Another conventional nib 1 for a fountain pen is provided at its tip with an abrasion-resistant pen point having a thin part for writing lean characters, and a thick part for writing full characters to enable the fountain pen to draw lines varying in width. Generally, when replacing the thin-stroke nib of a fountain pen for drawing thin lines with a thick-line nib for drawing thick lines, the feed tube of the fountain pen is not changed. Therefore, the air vent groove of the feed tube suitable for the thin-stroke nib is unable to allow a quantity of air corresponding to the consumption of the ink into the ink tank; consequently, the ink is not fed sufficiently to the tip of the thick nib, and faint and patchy lines are drawn.

Although the ink must flow from the ink feed groove 2*a* through the gap 5 to the slit 1*a*, the capillarity in the region between the ink feed groove 2*a* and the gap 5 is not high enough to transfer the ink from the ink feed groove 2*a* to the gap 5 because the thickness of the gap 5 is relatively large as shown in FIG. 20. Therefore, the fountain pen is shaken to force the ink to flow by inertia into the gap 5. Since the ink passage is formed by successively connecting the ink feed groove 2*a*, the gap 5 and the slit 1*a*, which are different in sectional area from each other, the ink is unable to flow smoothly.

Accordingly, it is an object of the present invention to provide a writing implement solving those problems in the prior art, and capable of always stably feeding the ink to the tip of a writing member so that the writing member is able to draw lines in a fixed width and in a fixed ink density.

Another object of the present invention is to provide a writing implement capable of enabling the removal of the dry ingredients of the ink sticking to the ink passage thereof from the ink passage.

A further object of the present invention is to provide a writing implement provided with a single writing member capable of drawing lines in two or more different thicknesses.

Still a further object of the present invention is to provide a writing implement capable of enabling smooth writing without interrupting the flow of the ink regardless of the inclination thereof to a writing surface.

SUMMARY OF THE INVENTION

With the foregoing objects in view, the present invention provides a writing implement provided with a writing member formed by superposing a plurality of thin strips and having an ink passage in the shape of a minute gap extending from the tip to the rear end thereof. Portions of respective rear ends of the plurality of thin strips forming the ink passage are fixedly joined together. Respective free portions of the plurality of thin strips can be elastically deformed when a pressure acts on the tips of the plurality of thin strips, such that the respective free portions of the plurality of thin strips slide relative to each other.

The present invention is characterized further in that the tip of at least one of the outer thin strips is provided with a slit communicating with the ink passage.

The present invention is further characterized in that the tips of the the outer thin strips among the plurality of thin strips are different in width from each other.

According to the present invention, the ink can be fed from an ink tank through the ink passage to the tip of the writing member. Therefore, the ink can be stably fed to the tip of the writing member without being affected by variation of the environment. Accordingly, lines can be drawn in a fixed thickness and in a fixed ink density. Thin lines can be drawn with shorter sides of the plurality of thin strips, and thick lines can be drawn with longer sides of the plurality of thin strips. Thus, the writing implement is capable of drawing lines selectively in any one of two or more thicknesses differing greatly from each other.

Furthermore, since the writing implement of the present invention may have only a single ink passage interconnecting the ink tank and the tip of the writing member, the writing implement is capable of sucking ink of a color different from that of the ink contained in the ink tank through the tip of the writing member when held in a substantially horizontal position.

According to the present invention, the writing member formed by superposing the plurality of thin strips is provided with the ink passage in the shape of a minute gap extending from the tip to the rear end thereof, and the portions of the rear ends of the thin strips are fixedly joined together so that the free portions of the plurality of thin strips are able be elastically deformed and to slide relative to each other. Therefore, dry ingredients of ink sticking to thin strips in the ink passage can be removed from the thin strips and the ink passage can be purged of the dry ingredients because the plurality of the thin strips can be elastically deformed by applying a pressure to the tips of the plurality of thin strips.

Furthermore, according to the present invention, the writing member is provided in its writing end with the slit communicating with the ink passage. Therefore, the ink can be readily transferred from the ink passage to a sheet of writing paper in both writing with the writing implement held in a first position to set the ink passage of the writing member thereof in contact with the sheet of writing paper to draw lines with the wider side of the writing member and writing with the writing implement held in a second position in which the wider side of the writing member is perpendicular to the sheet of writing paper to draw lines with the narrower side of the writing member.

According to the present invention, lines of two or more different widths can be drawn by forming the tips of the outer thin strips in different widths, respectively.

BEST MODE FOR CARRYING OUT THE INVENTION

Preferred embodiments of the present invention will be described in detail hereinafter with reference to the accompanying drawings.

Figure 1:
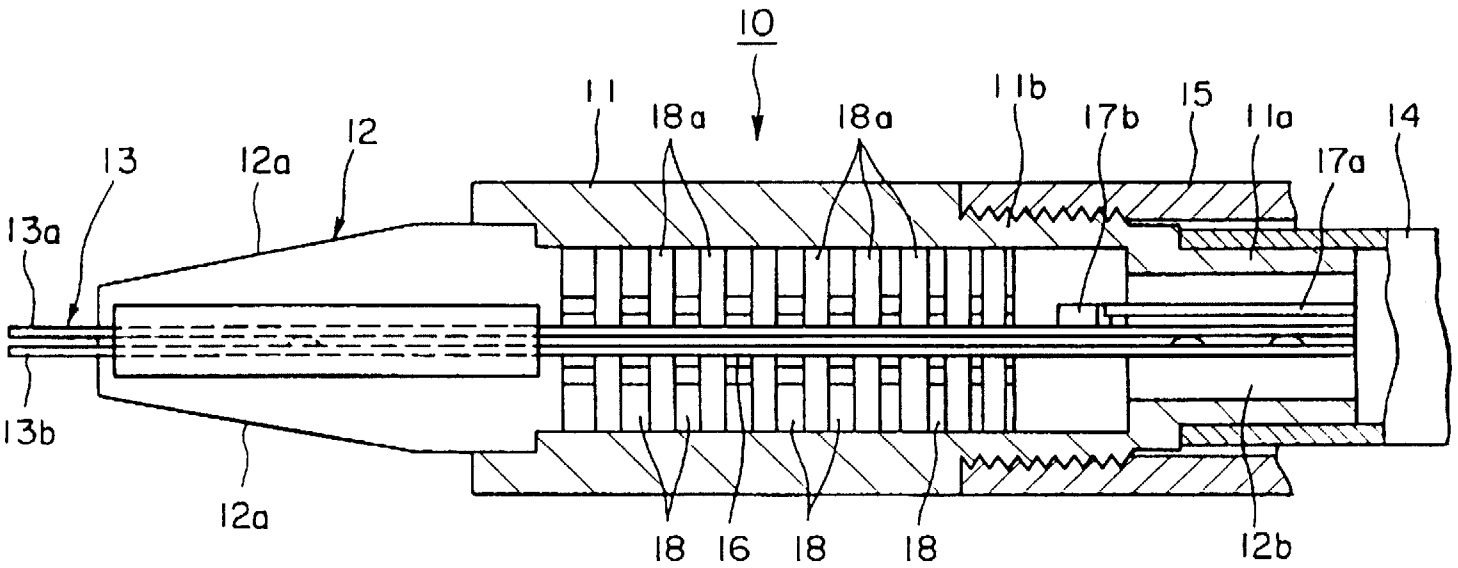
FIG. 1 is a fragmentary longitudinal sectional front view of a writing implement in a first embodiment according to the present invention taken on a plane.

Referring to FIG. 1, a writing implement generally indicated at 10 comprises a neck tube 11, a feed tube 12 and a writing member 13. The neck tube 11 formed in a tubular shape has a reduced rear end 11*a* of the smallest diameter on which an ink tank 14 is detachably positioned and an intermediate part 116 continuous with the rear end 11*a* and provided with an external thread. The intermediate part of the neck tube 11 is screwed in the internally threaded front end of a barrel 15.

Figure 2:
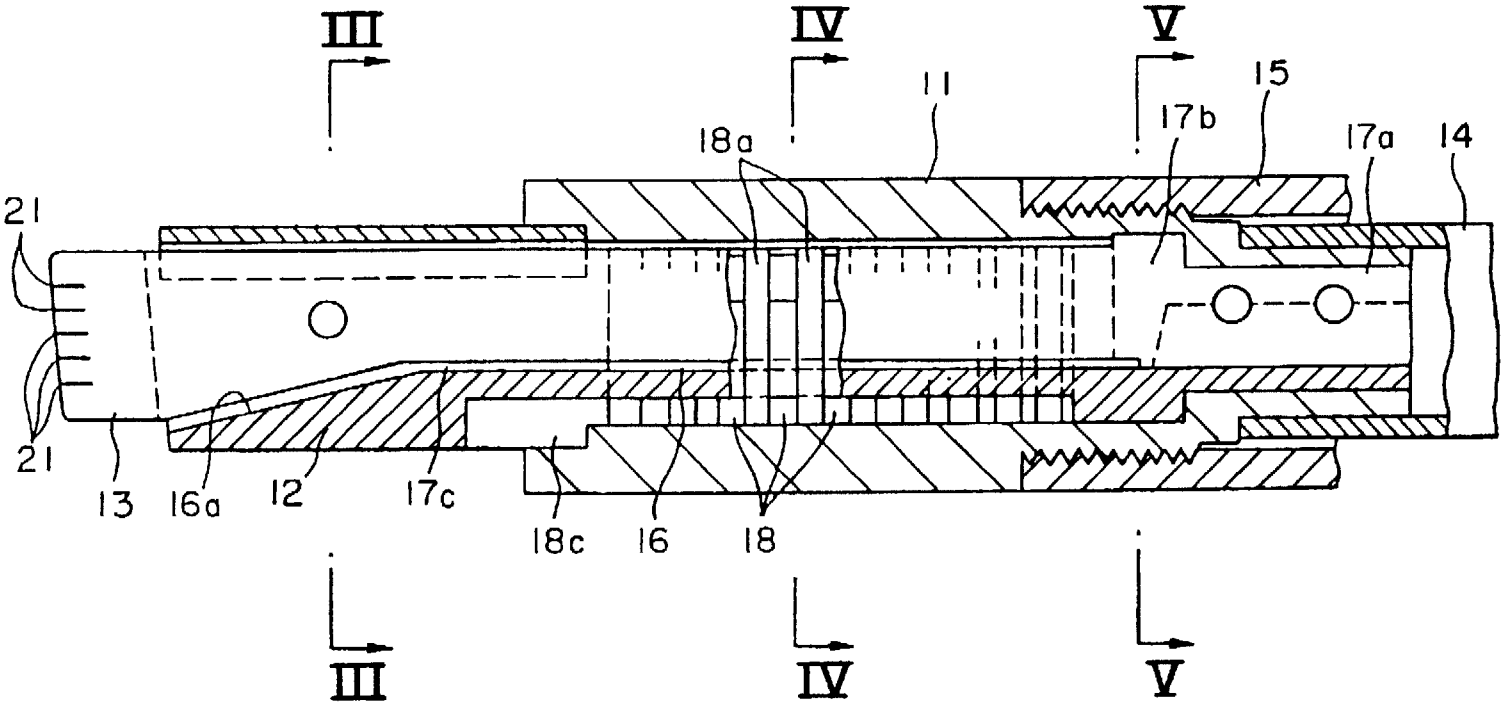
FIG. 2 is a fragmentary longitudinal sectional side view of the writing implement of FIG. 1.
Figure 3:
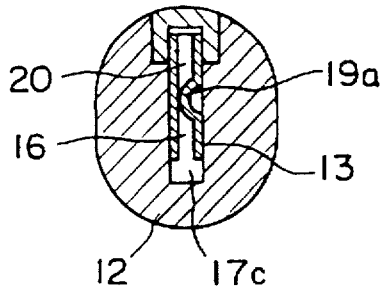
FIG. 3 is a cross-sectional view taken on the line A—A in FIG. 2.
Figure 4:
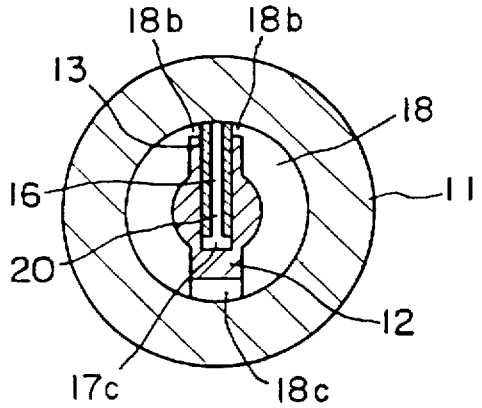
FIG. 4 is a cross-sectional view taken on the line B—B in FIG. 2.
Figure 5:
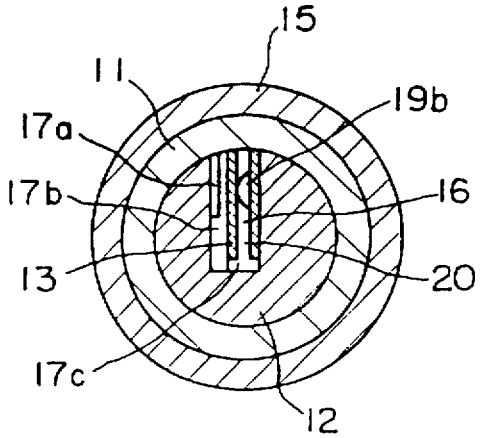
FIG. 5 is a cross sectional view taken on the line C—C in FIG. 2.

The rear end of the feed tube 12 is fitted in the neck tube 11, and the front part of the feed tube 12 projecting from the neck tube 11 is tapered toward the front to form taper surfaces 12*a*. The reduced rear end 12*b* of the feed tube 12 is formed in a cylindrical shape. The feed tube 12 is provided with an axial feed groove 16 extending between the front and the rear end of the feed tube 12 and having a rectangular cross section as shown in FIGS. 3, 4 and 5. As best shown in FIG. 2, the front end of the bottom surface 16*a* of the feed groove 16 is inclined so that the depth of the front part of the feed groove 16 increases toward the front. The rear end of the feed groove 16 communicates with the interior of the ink tank 14.

A first air vent groove 17*a* is formed in parallel to the feed groove 16 in the rear end of the feed tube 12 so as to communicate with the interior of the ink tank 14. A second air vent groove 17*b* is extended from the first air vent groove 17*a* so as to communicate with the feed groove 16. A third air vent groove 17*c* (FIG. 2), which will be described later, defined by the writing member 13 inserted in the feed groove 16 is connected to the second air vent groove 17*b*. The third air vent groove 17*c* communicates with the atmosphere at its front end, so that the ink tank 14 communicates with the atmosphere by way of the first air vent groove 17*a*, the second air vent groove 17*b* and the third air vent groove 17*c*. The respective sectional areas of the second air vent groove 17*b* and the third air vent groove 17*c* are greater than the sectional area of the first air vent groove 17*a*. The second air vent groove 17*b* and the third air vent groove 17*c* having the comparatively large sectional areas enables the ink to be sucked into the ink tank 14 at a high sucking speed and at a high sucking efficiency; that is, when the ink tank 14 is of a suction type, the ink can be sucked into the ink tank 14 through the third air vent groove 17*c* and the second air vent groove 17*b* in addition to sucking the ink through an ink passage 20, so that the ink can be efficiently sucked into the ink tank at a high sucking speed.

The feed of the ink from the ink tank 14 is regulated by the first air vent groove 17*a*. The ink tank 14 may be a replaceable ink cartridge.

The middle part of the feed tube 12 is provided with collector spaces 18 demarcated by fins 18*a* formed at predetermined intervals. As shown in FIG. 4, the collector spaces 18 communicate with the feed groove 16 by way of collector inlets 18*b*, and with the interior of the ink tank 14 by way of the feed groove 16.

The collector inlets 18*b* are gaps of 0.1 mm or below, and ink films are formed in the collector inlets 186, respectively, by surface tension. Thus, the collector inlets 18*b* serve as means for preventing communication by means of an ink film formed due to the surface tension of the ink. When sucking the ink through one end of the writing implement on the side of the writing member 13 into the ink tank 14 of a suction type, air is unable to flow into the ink passage 20, which will be described later, through the collector inlets 18*b* and the collector spaces 18 because the ink films covering the collector inlets 18*b* are not broken even if the internal pressure of the ink tank 14 is reduced.

Since the ink is not sucked into the collector spaces 18 when sucking the ink through one end of the writing implement on the side of the writing member 13, the ink can be efficiently sucked into the ink tank 14. Accordingly, the ink can be sucked into the ink tank 14 by immersing only the front half of the taper surfaces 12*a* of the feed tube 12 in the ink instead of immersing the collector spaces 18 in the ink contained in an inkwell.

As shown in FIG. 2, the third air vent groove 17*c* extends axially in the lower surface of the middle part of the feed tube 12 and communicate with the collector spaces 18. The third air vent groove 17*c* excluding its front part is covered with the neck tube 11, so that the collector spaces 18 communicates with the atmosphere by way of the front part of the third air vent groove 17*c*. Thus, the collector spaces 18 communicate with the interior of the ink tank 14 by way of the feed groove 16, and with the atmosphere by way of the front part of the third air vent groove 17*c* .

Figure 6:
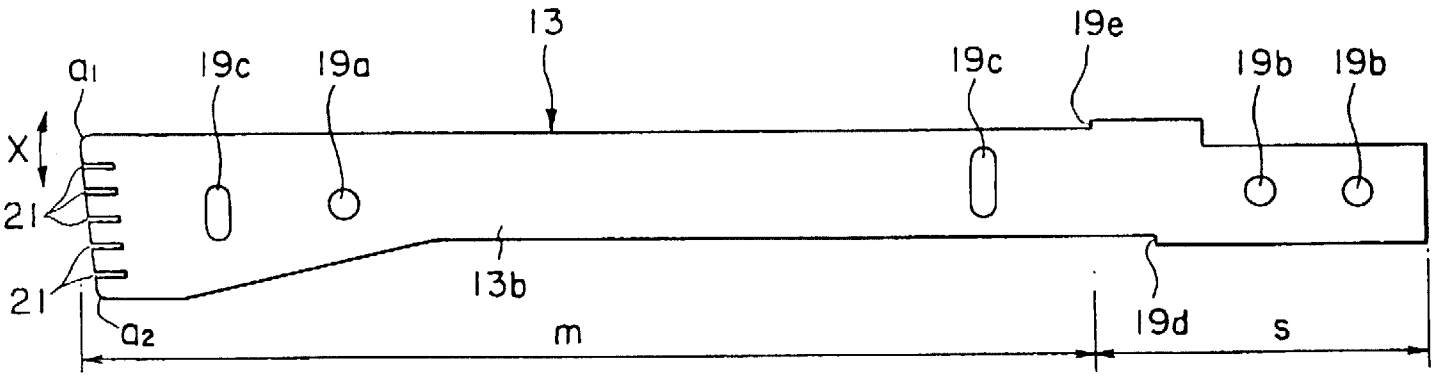
FIG. 6 is a side view of a writing member for a writing implement in accordance with the present invention.
Figure 7:
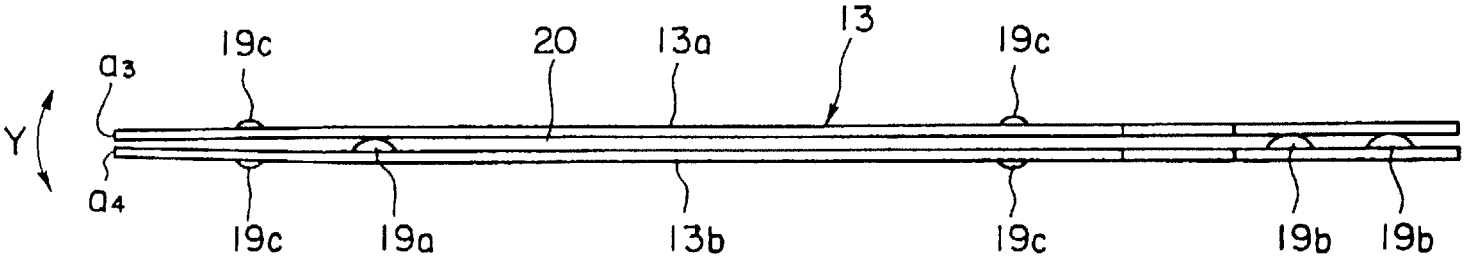
FIG. 7 is a plan view of the writing member of FIG. 6.

As shown in FIGS. 6 and 7, the writing member 13 comprises substantially rectangular, elastic thin plate-shaped strips 13*a* and 13*b* of the same shape of, for example, a stainless steel. Thus the thin strips 13*a* and 13*b* have excellent corrosion resistance, abrasion resistance, workability and cost performance. The thin strip 13*b* is provided in its front part with a protuberance 19*a* and in its rear part with protuberances 19*b*. The height of the protuberance 19*a* is determined so that the thickness of the space between the respective front parts of the thin strips 13*a* and 13*b* is on the order of 0.01 to 0.05 mm. The height of the protuberances 19*b* is determined so that the thickness of the space between the respective rear parts of the thin strips 13*a* and 13*b* is on the order of 0.07 to 0.15 mm. Thus, when the thin strips 13*a* and 13*b* are superposed one on top of the other, the ink passage 20 is formed between the thin strips 13*a* and 13*b*.

A method of superposing the thin strips 13*a* and 13*b* one on top of the other will be described below. The thin strips 13*a* and 13*b* are superposed one on top of the other with the protuberances 19*b* of the thin strip 13*b* in contact with the thin strip 13*a*, and then the thin strips 13*a* and 13*b* are welded together by laser welding or spot welding entirely or at a plurality of points in the rear parts (stationary region s) of the thin strips 13*a* and 13*b* in welds of the least possible size so that the ink passage is not narrowed and the front parts of the thin strips 13*a* and 13*b* are free to move. When a pressure is applied to the front parts of the thin strips 13*a* and 13*b*, parts of the thin strips 13*a* and 13*b* in an elastic region m other than the rear parts of the same in the stationary region s are deformed elastically, so that the thin strips 13*a* and 13*b* slide and are dislocated relative to each other.

Although, the thin strips 13*a* and 13*b* in this embodiment are welded together at the protuberances 19*b* of the thin strip 13*b*, the thin strips 13*a* and 13*b* may be superposed one on top of the other, and the edges of the rear parts of the thin strips 13*a* and 13*b* may be welded at a plurality of positions by laser intermittent edge welding. In the latter case, the protuberances 19*b* of the thin strip 13*b* serve only as means for forming the ink passage 20 between the thin strips 13*a* and 13*b*.

The parts of the thin strips 13*a* and 13*b* in the stationary region s may be fixedly joined together by a method other than the method using welding. For example, the thin strips 13*a* and 13*b* may be provided in their parts in the stationary region s with recesses and projections that engage with each other, and the thin strips 13*a* and 13*b* may be joined together with the recesses and the corresponding projections in engagement with each other. The engagement of the recesses and the corresponding projections has the same fixing effect as that of welds. The parts of the thin strips 13*a* and 13*b* in the stationary region s can be fixed relative to each other simply by superposing the thin strips 13*a* and 13*b* one on top of the other and fitting the thin strips 13*a* and 13*b* in the feed groove 16, which enables the omission of welding.

The thin strips 13*a* and 13*b* in this embodiment are spaced apart by the protuberances 19*a* and 19*b* so as to form the ink passage 20. The ink passage 20 may be formed between the thin strips 13*a* and 13*b* by other methods. For example, the thin strips 13*a* and 13*b* may be spaced apart with a spacer of an appropriate thickness disposed between the thin strips 13*a* and 13*b* to secure the ink passage 20, grooves may be formed by an etching process in the thin strips 13*a* and 13*b* so as to form the ink passage 20 when the thin strips 13*a* and 13*b* are superposed one on top of the other or steps may be formed in the thin strips 13*a* and 13*b* by press working, such as coining so as to form the ink passage 20 when the thin strips 13*a* and 13*b* are superposed one on top of the other.

Figure 8:
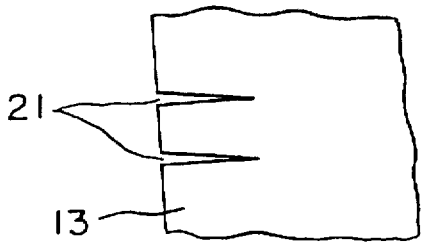
FIG. 8 is an enlarged fragmentary side view of the tip of the writing member of FIG. 6.
Figure 9:
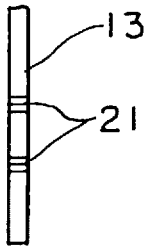
FIG. 9 is an enlarged front view of the writing tip of FIG. 6.

The front part of the lower edge of each of the superposed thin strips 13*a* and 13*b* is declined toward the front at a suitable inclination so that the front part extends in parallel to a slope formed in the front part of the bottom surface 16*a* of the feed groove 16 with a predetermined space therebetween. Each of the thin strips 13*a* and 13*b* is provided in its front end with five slits 21 of a width in the range of 0.01 to 0.05 mm (FIGS. 8 and 9). The ink fed through the ink passage 20 to the front ends of the thin strips 13*a* and 13*b* flows through the slits 21 to the tips of the thin strips 13*a* and 13*b*.

Therefore, even if the writing member 13 is inclined to the surface of a sheet of writing paper, not shown, the ink can be transferred from the writing member 13 to the sheet of writing paper. If the thin strips 13*a* and 13*b* are not provided with any slits 21, the ink cannot be transferred to a sheet of writing paper, not shown, unless the writing member 13 is held substantially perpendicularly to the surface of the sheet of writing paper.

Figure 10:
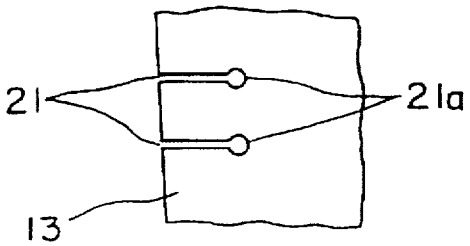
FIG. 10 is an enlarged fragmentary side view of a writing member embodying the present invention.
Figure 11:
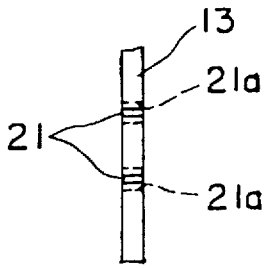
FIG. 11 is an enlarged front view of the writing member of FIG. 10.

The length of the slits 21 is approximately 0.5 to 1.0 mm and need not be as long as the 5.0 mm long splitting groove of the writing member of a conventional writing implement. Therefore, the strength of the front end of the writing member 13, i.e., the strength that withstands an external force that acts on the writing member 13 to vibrate the front end of the same, is high as compared with that of the writing member of a conventional writing implement. The slits 21 can be formed by a conventional process, such as shearing by a press or slitting by a grinding machine. Although the writing member 13 shown in FIGS. 8 and 9 is not provided with any pinholes at the terminal ends of the slits 21, the writing member 13 may be provided with pinholes 21*a* at the terminal ends of the slits 21, respectively, as shown in FIGS. 10 and 11.

Figure 15:
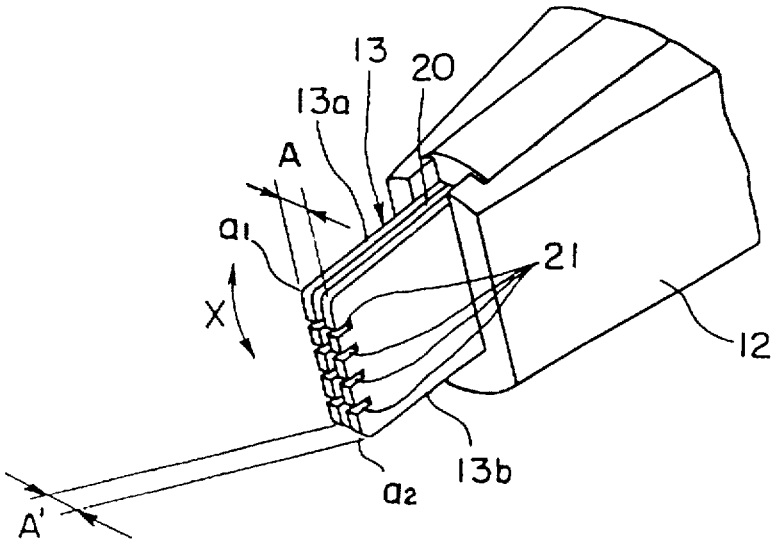
FIG. 15 is a fragmentary perspective view of a writing member embodying the present invention, of assistance in explaining the position of the writing member in a first writing mode.
Figure 16:
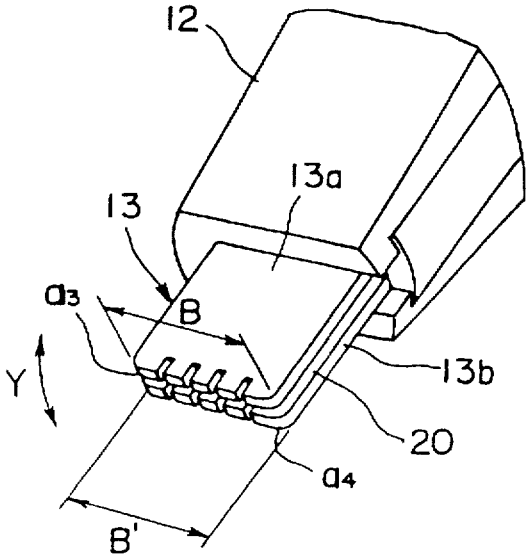
FIG. 16 is a fragmentary perspective view of the writing member of FIG. 15, of assistance in explaining the position of the writing member in a second writing mode.

The slits 21 of the thin strips 13*a* and 13*b* are formed so that the slits 21 of the thin strip 13*a* coincide substantially with those of the thin strip 13*b*, respectively as shown in FIGS. 15 and 16 when the thin strips 13*a* and 13*b* are superposed. Such an arrangement of the slits 21 is proper when the width of the slits 21 is small and the space between the thin strips 13*a* and 13*b* is narrow. However, in view of preventing the reverse flow of the ink against capillarity when the writing implement is held with the tip of the writing member directed in a direction opposite the direction of gravity, such as when the writing implement is held in a pocket or the like in an inverted position, the slits 21 may be formed so that the slits 21 of the thin strip 13*a* and those of the thin strip 13*b* are staggered relative to each other when the thin strips 13*a* and 13*b* are superposed.

The corners of the front edges of the thin strips 13*a* and 13*b* are rounded in a circular arc of a circle of 0.02 mm or above in radius to ensure the smooth sliding movement of the thin strips 13*a* and 13*b* on a sheet of writing paper. The corners of the thin strips 13*a* and 13*b* of the writing member 13 serve as a first contact part $a_1$ and a second contact part $a_2$ (FIG. 6). In a state shown in FIG. 15, the second contact part $a_2$ is in contact with a sheet of writing paper.

When the writing implement 10 used for writing in a position slightly turned from the position shown in FIG. 15, the thin strips 13*a* and 13*b* are deformed such that the thin strips 13*a* and 13*b* rub each other during writing. Consequently, dry ingredients of the ink deposited in the ink passage 20 are removed and the ink is able to flow smoothly through the ink passage 20. Although the widths A and A' of lines drawn with the first contact part $a_1$ and the second contact part $a_2$ are equal to each other, the widths A and A' are dependent on the radii of curvature of the rounded corners and may be different from each other.

As shown in FIG. 7, the wider edge of the thin strip 13*a* of the writing member 13 is a third contact part $a_3$, and the wider edge of the thin strip 13*b* is a fourth contact part $a_4$. The third contact part $a_3$ and the fourth contact part $a_4$ are used in a position as shown in FIG. 16. When the writing implement 10 is held for writing with the writing member 13 in the position shown in FIG. 16, the thin strip 13*a* and the thin strip 13*b* are deformed so as to rub each other in transverse directions and longitudinal directions, so that the dry ingredients of the ink sticking to the thin strips 13*a* and 13*b* in the ink passage 20 are removed from the thin strips 13*a* and 13*b*, and the ink passage 20 is purged of the dry ingredients of the ink during writing. Consequently, the ink is able to flow smoothly through the ink passage 20.

When the writing implement 10 is held for writing with the writing member 13 in the position shown in FIG. 16, a pressure acts intermittently on the thin strips 13*a* and 13*b*, and the thin strips 13*a* and 13*b* are deformed elastically and periodically. Since the thin strips 13*a* and 13*b* are deformed in different curvatures, respectively, the thin strips 13*a* and 13*b* slide relative to each other. Consequently, the dry ingredients of the ink sticking to the thin strips 13*a* and 13*b* in the ink passage 20 are removed from the thin strips 13*a* and 13*b*, the ink passage 20 is purged of the dry ingredients of the ink during writing and the ink is able to flow smoothly through the ink passage 20. The widths B and B' of lines drawn with the third contact part $a_3$ and the fourth contact part $a_4$ are equal to each other.

The writing member 13 thus formed is inserted through the feed tube 12 in the feed groove 16 so that the ink passage 20 communicates with the interior of the ink tank 14. The ink is drawn from the ink tank 14 into the ink passage 20 by capillarity, and the ink is fed through the ink passage 20 to the tip of the writing member 13. When the writing implement 10 is used for writing on a sheet of writing paper, the ink is transferred through the slits 21 formed in the tip of the writing member 13 to the sheet of writing paper.

Steps 19*d* and 19*e* are formed in the rear part of each of the thin strips 13*a* and 13*b* at positions near the stationary region s to form spaces between the writing member 13 and the surfaces of the feed groove 16 when the writing member 13 inserted in the feed groove 16. Therefore, the tip of the writing member 13 is can be displaced in the directions along its width, i.e., directions of the arrows Y in FIG. 16, when the writing implement 10 is held in a writing position as shown in FIG. 15 and a pressure acts on the tip of the writing member 13.

Since the writing member 13 has a very large section modulus, the displacement of the tip of the writing member 13 in the directions of the arrows X (FIG. 6) is as small as on the order of the thickness of the thin strips 13*a* and 13*b*. Therefore, when writing with the first contact part $a_1$ or the second contact part $a_2$ of the writing member 13, both the thin strip 13*a* and 13*b* can be set in contact with a sheet of writing paper. Since each of the thin strips 13*a* and 13*b* has the steps 19*d* and 19*e*, the writing member 13 displaced by the pressure acting on the contact part $a_2$ is able to restore its original shape easily when the pressure is removed from the writing member 13.

Furthermore, since each of the thin strips 13*a* and 13*b* has the step 19*d*, an air groove is formed between the thin strips 13*a* and 13*b* and the bottom surface of the feed groove 16. Although the steps 19*d* and 19*e* of each of the thin strips 13*a* and 13*b* in this embodiment shown in FIG. 6 are formed on the lower and the upper edge, respectively, as viewed in FIG. 6, of each of the thin strips 13*a* and 13*b* and are longitudinally dislocated relative to each other, the steps 19*d* and 19*e* may be formed on the lower and the upper edge, respectively, of each of the thin strips 13*a* and 13*b* at the same longitudinal position or the respective longitudinal positions of the steps 19*d* and 19*e* may be reversed. The steps 19*d* and 19*e* may be formed on the writing member 13 as mentioned above or recesses or grooves may be formed in the surfaces of the feed groove 16 of the feed tube 12 for the same effect as that of the steps 19*d* and 19*e*.

Protuberances 19*c* are formed on the outer surfaces of the thin strips 13*a* and 13*b* to prevent rattling of the writing member 13 in the feed groove 16. The protuberances 19*c* need not necessarily be formed on the thin strips 13*a* and 13*b* and protuberances corresponding to the protuberances 19*c* may be formed on the side surfaces of the feed groove 16 for the same effect.

Figure 12:
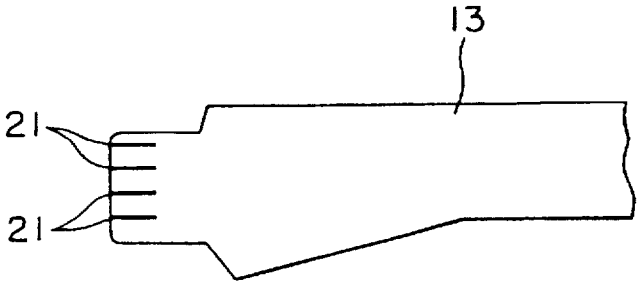
FIG. 12 is a fragmentary side view of a writing member embodying the present invention.

FIG. 12 shows a writing member 13 embodying the present invention. The writing member 13 shown in FIG. 12 has a third contact part $a_3$ and a fourth contact part $a_4$ narrow than those of the writing member 13 shown in FIG. 6. The respective widths of the third contact part $a_3$ and the fourth contact part $a_4$ are optional and dependent on the width of the tip of the writing member 13. The 30 respective widths of the first contact part $a_1$ and the second contact part $a_2$ of the writing member 13 are dependent on the respective thicknesses of the thin strips 13*a* and 13*b* and the ink passage 20 as shown in FIG. 7 and are fixed. Therefore, the shape of the feed groove 16 need not be changed even if the respective widths of the first contact part $a_1$ and the second contact part $a_2$ are changed.

Figure 13:
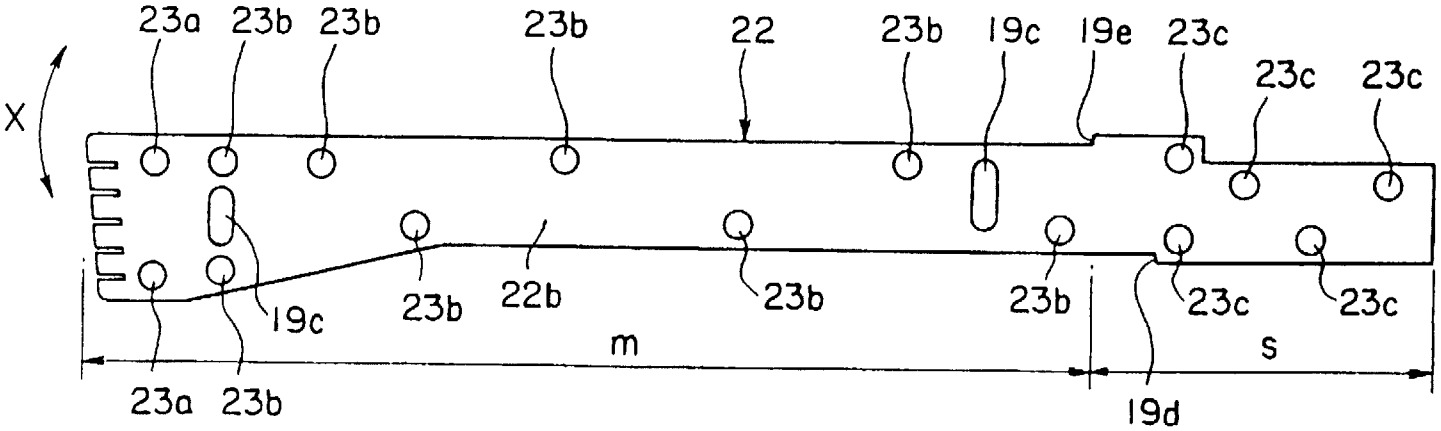
FIG. 13 is side view of a writing member embodying the present invention.
Figure 14:
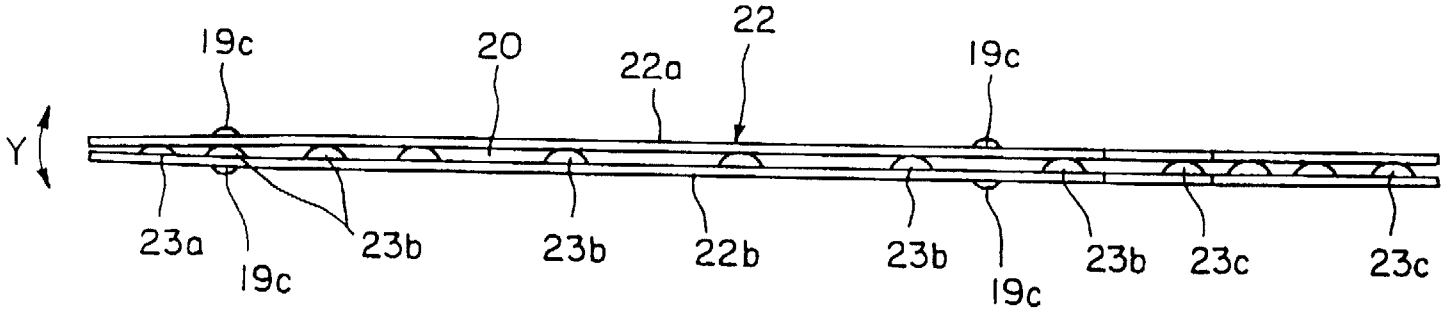
FIG. 14 is a plan view of the writing member of FIG. 13.

FIGS. 13 and 14 show another writing member 22 embodying the present invention, which is similar to the writing member 13 shown in FIGS. 6 and 7, except that the writing member 22 is provided with more protuberances than the writing member 13. The writing member 22 will be described with reference to FIGS. 1, 13 and 14, in which parts like or corresponding to those of the writing member 13 shown in FIGS. 6 and 7 are designated by the same reference characters and the description thereof will be omitted.

The writing member 22 comprises thin strips 22*a* and 22*b* of the same shape. The thin strip 22*b* is provided with protuberances 23*a* in its front part, protuberances 23*b* in its middle part, and protuberances 23*c* in its rear part. The height of the protuberances 23*a* is determined so that the respective front parts of the thin strips 22*a* and 22*b* are spaced approximately 0.01 to 0.05 mm apart when the thin strips 22*a* and 22*b* are superposed one on top of the other. The height of the protuberances 23*b* and that of the protuberances 23*c* are determined so that the thin strips 22*a* and 22*b* are spaced approximately 0.07 to 0.15 mm apart when the thin strips 22*a* and 22*b* are superposed. Thus, an ink passage 20 is formed between the superposed thin strips 22*a* and 22*b*.

When combining the thin strips 22*a* and 22*b*, the thin strips 22*a* and 22*b* are superposed with the thin strip 22*a* in contact with the protuberances 23*c* of the thin strip 22*b*, and then the thin strips 22*a* and 22*b* are welded together by spot welding or laser welding entirely or at a plurality of points in the rear parts (stationary region s) of the thin strips 22*a* and 22*b* in welds of the least possible size so that the ink passage is not narrowed and the front parts of the thin strips 22*a* and 22*b* are free to move. When a pressure is applied to the front parts of the thin strips 22*a* and 22*b*, parts of the thin strips 22*a* and 22*b* in an elastic region m other than the rear parts of the same in the stationary region s are deformed elastically, so that the thin strips 22*a* and 22*b* slide and are dislocated relative to each other.

The thin strip 13*a* of the writing member 13 provided with the slits 21, and the thin strip 22*a* of the writing member 22 provided with slits 21 among the thin strips 13*a* and 13*b* of the writing member 13 and the thin strips 22*a* and 22*b* of the writing member 22 are not provided with any protuberances like the protuberances 19*a*, 19*b*, 23*a*, 23*b* and 23*c*. Naturally, the protuberances 19*a* and 19*b* may be distributed to both the thin strips 13*a* and 13*b*, and the protuberances 23*a*, 23*b* and 23*c* may be distributed to both the thin strips 22*a* and 22*b* for the same effect.

It is also possible to divide the feed tube 12 into two parts, namely, a first part for holding the thin strip 13*a* or 22*a*, and a second part for holding the thin strip 13*b* or 22*b*, to fix the thin strip 13*a* or 22*a* to the first part, and the thin strip 13*b* or 22*b* to the second part, and to form the ink passage 20 between the thin strips 13*a* and 13*b* or between the thin strips 22*a* and 22*b* when the first part holding the thin strip 13*a* or 22*a* and the second part holding the thin strip 13*b* or 22*b* are inserted in the neck tube 11. The protuberances 19*c* of the foregoing writing members 13 and 22 apparently increase the capillary width of a section of the ink passage 20 corresponding to the protuberances 19*c*, which may break the flow of the ink through the ink passage 20. Therefore, the protuberances 19*c* must be formed in the least possible width. The protuberances 19*c* are unnecessary when the combination of the feed tube 12 and the writing member 13 or 22 is formed by insert injection molding. The thin strips 13*a* and 22*a* or the thin strips 13*b* and 22*b* provided with small holes may be combined with the feed tube 12 by insert molding so that projections are formed through the small holes to define a gap that serves as the ink passage, instead of forming the protuberances 19*a* and 19*b* on the thin strip 13*b* or forming the protuberances 23*a*, 23*b* and 23*c* on the thin strip 22*b*.

The functions of the writing member thus formed will be described below.

First, the flow of the ink through the writing member incorporated into the writing implement will be described with reference to FIG. 1. The writing member 13 (the writing member 22) forms the ink passage 20 between the thin strips 13*a* and 13*b* (22*a* and 22*b*), and the ink passage 20 communicates with the interior of the ink tank 14 to draw the ink from the ink tank 14 through the ink passage 20 to the contact part of the writing member 13 (the writing member 22) by capillarity. Thus, the ink contained in the ink tank 14 can be smoothly fed to the contact part of the writing member 13 (the writing member 22).

As the ink contained in the ink tank 14 is consumed, air flows through the air grooves 17*a*, 17*b* and 17*c* into the ink tank 14. The ink forced to flow out of the ink tank 14 by the expansion of air contained in the ink tank is stored in the collector spaces 18, forcing the air filling up the collector spaces 18 to flow outside. Thus, the dripping of the ink can be prevented.

When the ink is forced to flow out of the ink tank 14 by the expansion of air contained in the ink tank 14, the air grooves 17*b* and 17*c* are filled up with the ink to prevent the dripping of the ink. When the writing implement 10 is used for writing, first the ink stored in the air grooves 17*b* and 17*c* and the collector spaces 18 is fed to the contact part and consumed.

After the ink stored in the air grooves 17*b* and 17*c* and the collector spaces 18 has been completely consumed, air flows through the air grooves 17*a*, 17*b* and 17*c* into the ink tank 14, and the ink is fed from the ink tank 14 through the ink passage 20 to the contact part of the writing member 13 (the writing member 22). On the other hand, when the air contained in the ink tank 14 contracts, the ink stored in the air grooves 17*b* and 17*c* and the collector spaces 18 is sucked into the ink tank.

When the writing implement 10 is held and used in a position shown in FIG. 15 for writing, the writing member 13 (the writing member 22) is displaced in directions along the width, i.e., in the directions of the arrows X in FIG. 15, by a pressure acting on the tip thereof. Since the writing member 13 (the writing member 22) has a very large section modulus, the displacement of the tip of the writing member 13 (the writing member 22) in the directions of the arrows X is very small. However, both the thin strips 13*a* and 13*b* (the thin strips 22*a* and 22*b*) can be set in contact with the sheet of writing paper when the displacement is as large as the thickness of the thin strips 13*a* and 13*b* (the thin strips 22*a* and 22*b*).

Since each of the thin strips 13*a* and 13*b* (the thin strips 22*a* and 22*b*) has the steps 19*d* and 19*e* as shown in FIG. 6, the writing member 13 (the writing member 22) displaced by the pressure acting on the tip thereof is able to restore its original shape easily when the pressure is removed from the writing member 13 (the writing member 22). When the writing implement 10 is used in the position shown in FIG. 15, lines of widths A and A', which are equal to each other, can be drawn.

When the writing implement 10 is held and used in a position set by slightly turning the writing implement 10 about its axis from the position shown in FIG. 15, the thin strips 13*a* and 13*b* (the thin strips 22*a* and 22*b*) slide up and down relative to each other. Consequently, the dry ingredients of the ink sticking to the thin strips 13*a* and 13*b* (the thin strips 22*a* and 22*b*) in the ink passage 20 are removed from the thin strips 13*a* and 13*b* (the thin strips 22*a* and 22*b*), and the ink passage 20 is purged of the dry ingredients of the ink during writing, so that the ink is able to flow smoothly through the ink passage 20.

When the writing implement 10 is held and used in a position shown in FIG. 16, the third contact part $a_3$ or the fourth contact part $a_4$ of the writing member 13 (the writing member 22) works for writing. The width B of lines drawn with the third contact parts $a_3$ and the width B' of lines drawn with the fourth contact part $a_4$ are greater than the widths A and A' shown in FIG. 15. Although the writing member 13 (the writing member 22) is displaced in the directions of the arrows Y when the writing implement 10 is held and used in the position shown in FIG. 16, the thickness of the space between the respective front parts of the thin strips 13*a* and 13*b* (the thin strips 22*a* and 22*b*) can be maintained on the order of 0.01 to 0.05 mm by the protuberance 19*a* formed in the front part of the writing member 13 (FIG. 6) (the protuberances 23*a* and 23*b* formed in the front part of the writing member 22 (FIG. 13)).

When a pressure acts on the third contact part $a_3$ or the fourth contact part $a_4$ of the writing member 13 (the writing member 22) during writing, the thin strips 13*a* and 13*b* (the thin strips 22*a* and 22*b*) are deformed in different curvatures, respectively, the thin strips 13*a* and 13*b* (the thin strips 22*a* and 22*b*) slide relative to each other because the front parts of the thin strips 13*a* and 13*b* (the thin strips 22*a* and 22*b*) are free to move. Consequently, the dry ingredients of the ink sticking to the thin strips 13*a* and 13*b* (thin strips 22*a* and 22*b*) in the ink passage 20 are removed from the thin strips 13*a* and 13*b* (thin strips 22*a* and 22*b*), the ink passage 20 is purged of the dry ingredients of the ink during writing and the ink is able to flow smoothly through the ink passage 20.

Figure 17:
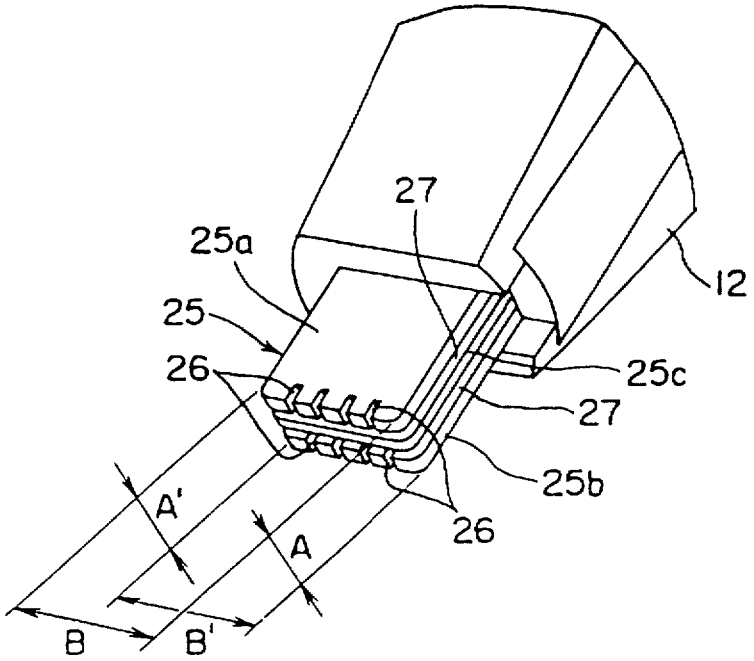
FIG. 17 is a fragmentary perspective view of a writing member embodying the present invention, of assistance in explaining the position of the writing member in a first writing mode.

Although the writing members 13 and 22 in the foregoing embodiments comprise the two thin strips 13*a* and 13*b*, and the two thin strips 22*a* and 22*b*, respectively, a writing member 25 may comprise three thin strips 25*a*, 25*b* and 25*c* as shown in FIG. 17. The widths A and A' of lines drawn with the writing member 25 are wider than the widths A and A' of lines drawn with the writing members 13 and 22. The widths B and B' of lines drawn with the writing member 25 are equal to the widths B and B' of lines drawn with the writing member 13 shown in FIG. 16.

Figure 18:
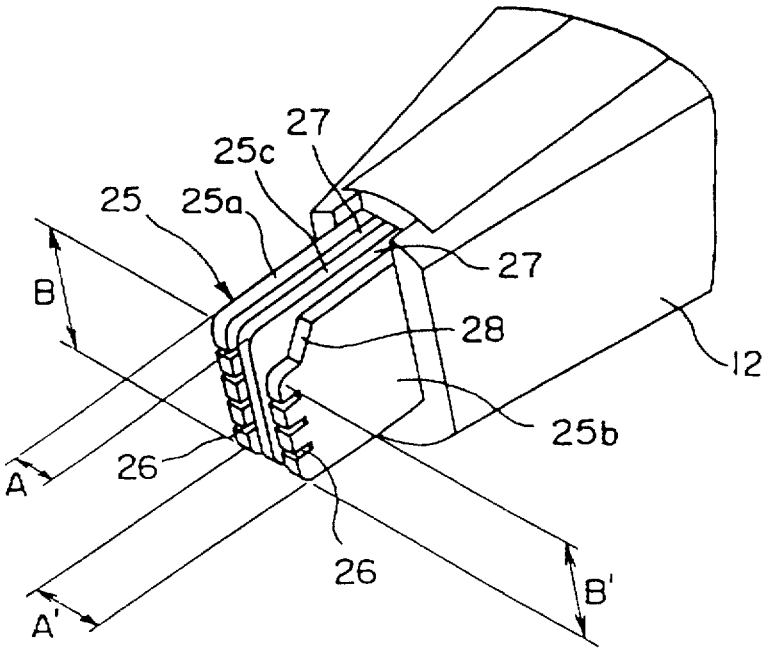
FIG. 18 is a fragmentary perspective view of a writing member embodying the present invention, of assistance in explaining the position of the writing member in a writing mode.
Figure 19:
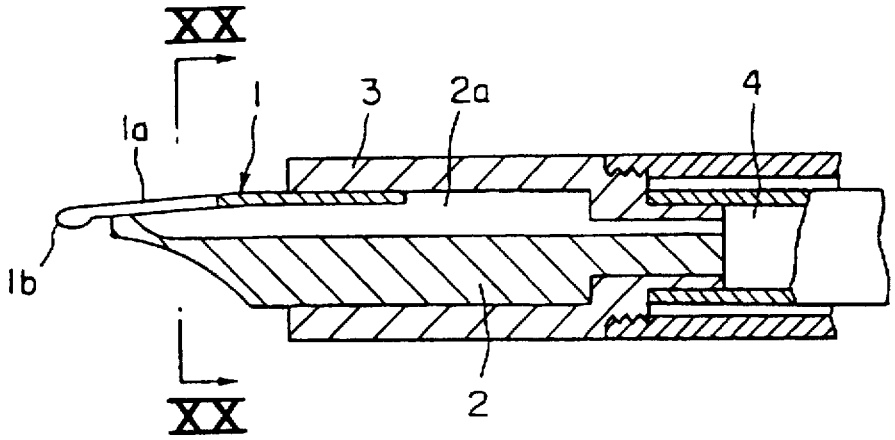
FIG. 19 PRIOR ART
FIG. 19 is fragmentary longitudinal sectional side view of a conventional writing implement.
Figure 20:
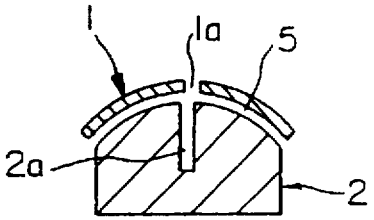
FIG. 20 PRIOR ART
FIG. 20 is a cross-sectional view taken on the line D—D in FIG. 19.
Figure 21:
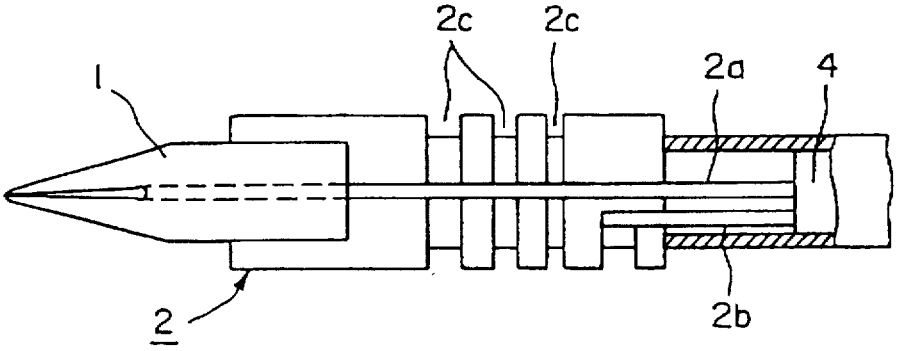
FIG. 21 PRIOR ART
FIG. 21 is a partly sectional plan view a portion of the writing implement of FIG. 19.
Figure 22:
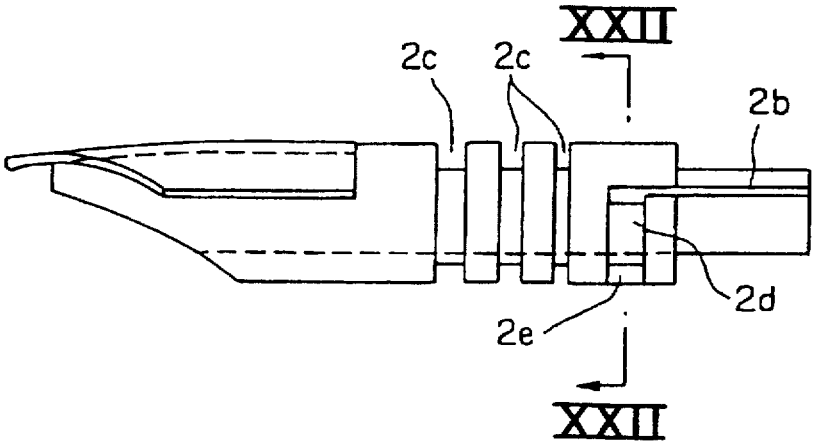
FIG. 22 PRIOR ART
FIG. 22 is a side view of a portion of a prior art writing implement.
Figure 23:
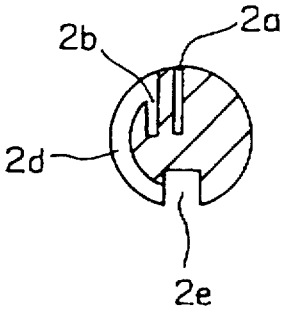
FIG. 23 PRIOR ART
FIG. 23 is a cross-sectional view taken on line E—E in FIG. 22.

One corner of the outer thin strip 25*b* may be cut to form a recess 28 to form a writing strip 25 as shown in FIG. 18. The width A of lines drawn with the writing member 25 of FIG. 18 is smaller than the width A of lines drawn with the writing member 25 of FIG. 17. Although only the outer thin strips 25*a* and 25*b* of each of the writing members 25 shown in FIGS. 17 and 18 are provided in their front parts with slits 26, the middle thin strip 25*c* may be provided in its front part with slits. When all the thin strips 25*a*, 25*b* and 25*c* are provided in their front parts with the slits 26, ink passages 27 communicate with each other by means of the slits formed in the middle thin strip 25*c*, and the same quantity of the ink can be transferred from the ink passages 27 to a sheet of writing paper.

In the writing implement 10 in accordance with the present invention, the ink tank 14 communicates with the contact part of the writing member 13 by means of the single ink passage 20, and the ink contained in the ink tank 14 can be fed to the contact part of the writing member 13 by capillarity. Therefore, the ink of another color different from that of the ink contained in the ink tank can be readily sucked into the ink tank 14 from a dropping pipette or other writing implement by holding the writing implement 10 in a horizontal position and setting the contact part of the writing implement 10 in contact with the dropping pipette or the contact part of the other writing implement.

When thus sucking the ink of another color different from that of the ink contained in the ink tank 14 into the ink tank 14, the ink staying in the ink passage 20 is caused to flow reverse by the water head of the ink of another color sucked in from an external ink source, so that the ink of the another color is sucked into the ink passage 20 without mixing with the ink previously filling up the ink passage 20. Accordingly, a continuous color variation, i.e., color gradation, can be expressed by using the writing implement 10 containing the two kinds of ink of the different colors.

When a line is drawn with the writing implement 10 containing the ink of another color in the ink passage 20, first the line is drawn in the color of the ink of another color, the color tone changes gradually into a color tone developed by the mixture of the two kinds of ink of different colors, which is called gradation, and then, after the ink of another color contained in the ink passage 20 has exhausted, the line is drawn in the color of the ink which had been originally filling up the ink passage 20 before the ink of another color was sucked into the ink passage 20.

If the ink of another color is sucked into the writing implement 10 through one corner of each of the thin strips 13*a* and 13*b* (the thin strip 22*a* and 22*b*) of the writing member 13 (the writing member 22), the ink of another color is transferred from only the same corners of the thin strips 13*a* and 13*b* (the thin strip 22*a* and 22*b*) to a sheet of writing paper when writing with the writing implement 10 held so that a line is drawn in the line width B or B' (FIG. 16). Therefore, only lines drawn with the same corners of the thin strip 13*a* and 13*b* (the thin strip 22*a* and 22*b*) of the writing member 13 (the writing member 22) are drawn in gradation; that is, first only one side of the width of a line is drawn in the color of the ink of another color, the color tone changes gradually into a color tone developed by the mixture of the two kinds of ink of different colors in gradation, and then the entire width of the line is drawn in the color of the ink which had been originally filling up the ink passage 20 before the ink of another color was sucked into the ink passage 20. If the ink of another color is sucked into the writing implement 10 through one corner of each of the thin strips 13*a* and 13*b* (the thin strip 22*a* and 22*b*) of the writing member 13 (the writing member 22) in an extended time, the width of the ink of another color in the ink passage 20 increases gradually toward the ink tank 14; that is, the ink of another color is sucked into the ink passage so as to widen toward the ink tank 14.

Therefore, when writing with the writing implement 10 held so that a line is drawn in the line width B or B' (FIG. 16), one side of the line is drawn in the color of the ink of another color sucked into the ink passage 20 and the other side of the line is drawn in the color of the ink contained in the ink tank 14 in the initial stage of writing, the entire width of the line changes soon into the color of the ink of another color sucked from the external ink source, and then the color of the line changes in gradation into the color of the ink contained in the ink tank 14.

CAPABILITY OF UTILIZATION IN INDUSTRY

The writing implement in accordance with the present invention is suitable for writing characters of strokes of different widths and writing color characters.

I claim:

1. A writing implement comprising:

a barrel to receive therein an ink tank, said barrel having a front end;

a feed tube mounted at said front end of said barrel, said feed tube having a feed groove extending therethrough;

a writing member including strips superposed on each other and defining therebetween a minute gap forming an ink passage extending therethrough, said strips having rear parts fixedly secured to each other and remaining parts forwardly of said rear parts not secured to each other and resiliently movable relative to each other;

said writing member being fitted in said feed groove of said feed tube with a front part of said writing member projecting forwardly from a front end of said feed tube and with said ink passage located to communicate with the ink tank to be received in said barrel;

whereby when writing pressure is applied to said front part of said writing member, said remaining parts other than said fixedly secured rear parts of said strips are caused to slide relative to each other during writing, thereby to remove dry ingredients of ink sticking to said strips.

2. A writing implement as claimed in claim 1, wherein each said strip comprises a plate-shaped member having opposite substantially planar surfaces.

3. A writing implement as claimed in claim 2, wherein respective confronting planar surfaces of said strips define therebetween said minute gap forming said ink passage.

4. A writing implement as claimed in claim 1, wherein said writing member is axially immovably positioned relative to said feed tube.

5. A writing implement as claimed in claim 1, wherein said strips are pressed toward each other by inner surfaces defining said feed groove.

6. A writing implement as claimed in claim 1, wherein front portions of said strips projecting forwardly from said front end of said feed tube have formed therein slits in communication with said ink passage.

7. A writing implement as claimed in claim 1, wherein a rear part of said feed tube has collector spaces to contain ink and to be in communication with the ink tank and air grooves for enabling air to flow from the exterior to the ink tank.

8. A writing implement as claimed in claim 1, wherein some of said strips have different widths.

9. A writing implement as claimed in claim 1, wherein said strips have respective confronting surfaces separated by protuberances of at least one said strip, said protuberances thus defining said ink passage.

10. A writing implement as claimed in claim 1, comprising at least three said strips that are stacked relative to each other such that each adjacent pair of strips define therebetween a respective said minute gap forming a respective said ink passage.

* * * * *